United States Patent [19]

Yoneji et al.

[11] 4,137,860

[45] Feb. 6, 1979

[54] ELECTRICAL DRIVE SYSTEM FOR A SEWING MACHINE

[75] Inventors: Satoshige Yoneji; Yoshiharu Higuchi; Shushin Mori, all of Nagoya, Japan

[73] Assignee: Brother Kogyo Kabushiki Kaisha, Nagoya, Japan

[21] Appl. No.: 879,106

[22] Filed: Feb. 17, 1978

[30] Foreign Application Priority Data

Feb. 18, 1977 [JP] Japan ..... 52-17432

[51] Int. Cl.[2] ..... D05B 69/26

[52] U.S. Cl. ..... 112/277; 112/275; 318/371

[58] Field of Search ..... 112/277, 275, 67, 87; 318/371, 375

[56] References Cited

U.S. PATENT DOCUMENTS

| | | | |
|---|---|---|---|
| 3,804,043 | 4/1974 | Benson et al. | 112/275 |
| 3,860,860 | 1/1975 | Moran et al. | 318/375 |
| 4,014,277 | 3/1977 | Morinaga et al. | 112/277 |

*Primary Examiner*—Peter Nerbun

*Attorney, Agent, or Firm*—Browdy and Neimark

[57] ABSTRACT

An improved speed controlling system for an electric motor, mainly used in a sewing machine includes a motor connected to a power supply, a speed controlling circuit or circuits for operating the motor at variably controlled speeds, and an electrical braking circuit or circuits for braking the motor upon receiving deceleration command from the speed controlling circuit(s) to transfer the motor from a high speed running state to a low speed running one. Electromechanical braking means are provided for acting on the motor, during at least a part of the braking period, the braking means being controlled by the electrical braking circuit(s). A low speed setting circuit is disposed in the speed controlling circuit(s) for maintaining the low speed running state caused by the electromechanical braking means and the electrical braking circuit(s). A stoppage commanding circuit is provided for stopping the motor operation, after the motor has been transferred to its low speed running state by a low speed setting circuit, by means of actuating again, owing to a stopping command, the electrical braking circuit(s) and/or the electromechanical braking means.

15 Claims, 11 Drawing Figures

MAGNETIC RESISTANCE ELEMENT
AMPLIFIER
FLIP-FLOP
TIMER
HALL ELEMENT
SWITCH
MONOSTABLE MULTI-VIBRATOR
+12V
0V (a)

(d)

(b)

| CL | PR | Qn+1 |
|---|---|---|
| L | L | Qn |
| L | H | H |
| H | L | L |
| H | H | L |

L: ZERO
H: ONE (C)

| tn | | tn+1 |
|---|---|---|
| D | Qn | Qn+1 |
| L | L | L |
| L | H | L |
| H | L | H |
| H | H | H |

L: ZERO
H: ONE

ELECTRICAL DRIVE SYSTEM FOR A SEWING MACHINE

BACKGROUND OF THE INVENTION

This invention relates to controlling arrangement for a motor in the electrical drive system, more particularly, to that system used chiefly in an industrial sewing machine for the purpose of halting or stopping the machine and its needle at a certain preset position.

With regard to this sort of controlling arrangement, a conventionally practiced method of applying dynamic braking on the motor responding to a decelerating command for altering a high speed running down to a low speed running, and applying again, after having kept it running at the low speed for a while, the dynamic braking upon receiving a stopping command signal or employing an electromechanical braking means such as an electromagnetic brake, is known as a prior art of stopping a running motor for a sewing machine.

In this conventional method, it used to take a considerable length of time until the motor was completely stopped after a decelerating command signal had been produced, which was not a negligible factor with regard to efficient operation of industrial sewing machines and the like.

In the study of reasons for the delay, it was found that the period of time required for changing the speed from high to low after the command signal for the deceleration has been produced was the longest of all, i.e., the principal reason for the malefficiency of the conventional machines.

SUMMARY OF THE PRESENT INVENTION

The inventor of this invention has succeeded in shortening of the period of time used for transferring the high speed running down to the low speed running. The gist of this invention can be said to be a parallel employing of an electric braking means and an electromechanical braking means, the former being high efficient during the relatively high speed running period of the machine, and the latter, which is little affected by the speed degree, being favorable after the machine has come down to a low speed running range.

It is a primary object of this invention to provide a controlling system for a motor, mainly used in an industrial sewing machine, which enables a speedy and smooth halting of the motor, eliminating the disadvantages of the prior art.

It is another object of this invention to reduce the time span required between the deceleration command and the actual halting of the motor.

It is still another object of this invention to provide a controlling system for a motor which enables the machine needle to stop at a preset position.

It is further object of this invention to provide a controlling system for a motor wherein an electric controlling circuit is aided by an electromechanical braking means at least for a part of the decelerating period.

It is still further object of this invention to provide a controlling system for a motor, wherein a DC motor and a dynamic braking circuit are made practicable.

DETAILED DESCRIPTION OF THE PREFERRED EMBODIMENT

A preferred embodiment of a drive system of the present invention is described, with reference to the appended drawings.

Figure 1:
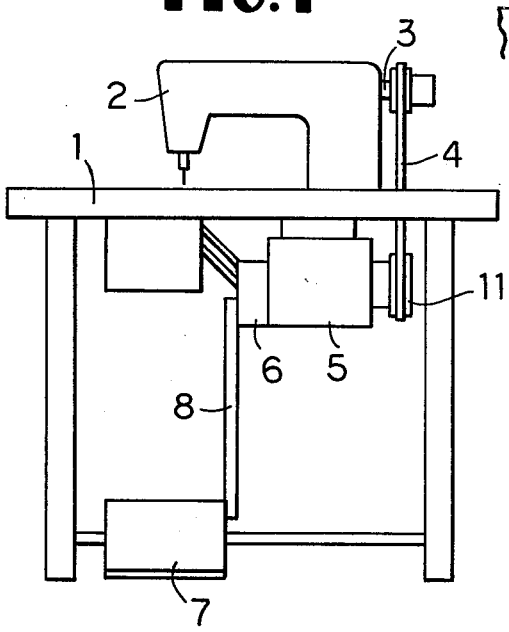
FIG. 1 is an elevation of a sewing machine in which a preferred embodiment of the present invention is incorporated.

As shown in FIG. 1, a sewing machine 2 for industrial use is mounted on a machine table 1 in the usual way, a drive or main shaft 3 of which machine 2 is connected, via a belt 4, to a DC motor 5 disposed under the table 1.

The DC motor 5 is provided with a switch box 6 attached to the left side (in FIG. 1) of the bracket thereof. Numeral 7 designates a pedal or foot treadle capable of being depressed toward toe side as well as heel side, which is through a rod 8 connectd to an input switch or the like in the switch box 6.

Figure 2:
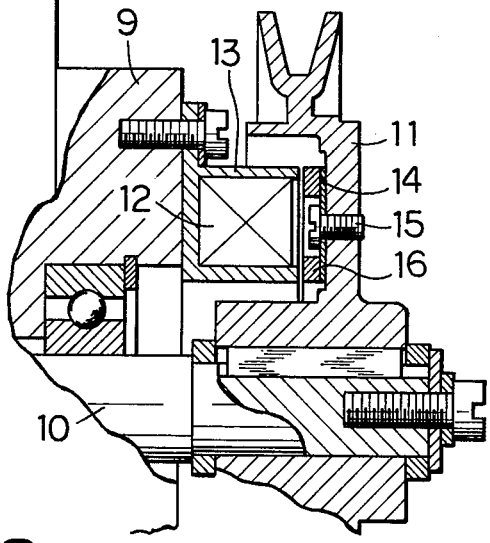
FIG. 2 is a vertical sectional view, in enlargement, of a portion of the machine in which an electromechanical braking system has been incorporated.

As clearly can be seen in FIG. 2, an electromagnetic braking means as an electromechanical braking means acting on the DC motor 5 is disposed between a bracket 9 and a pulley 11, which is secured to an output shaft 10 of the motor 5. The electromagnetic brake includes a braking coil 12, and is composed of a supporting body 13 therefor attached to the bracket 9 and a substance-to-be-attracted 16 made of steel which is attached to the pully 11, via an elastic plate 14 disposed with a small gap of 0.2 mm or so from the supporting body 13, with a screw 15; when the coil 12 is energized the elastic plate 14 will be deflected to render the substance-to-be-attracted 16 to engage with the supporting body 13.

Figure 3:
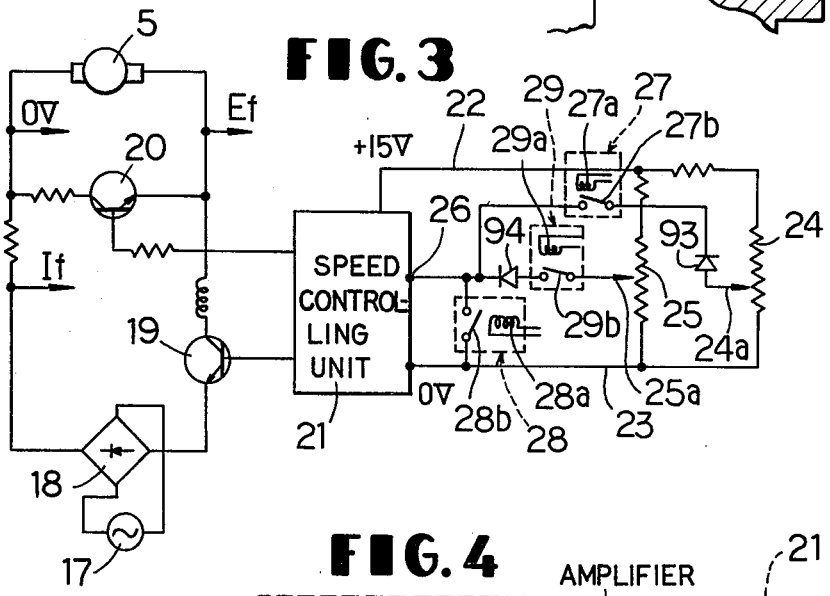
FIG. 3 is a diagram of the speed controlling circuit.
Figure 4:
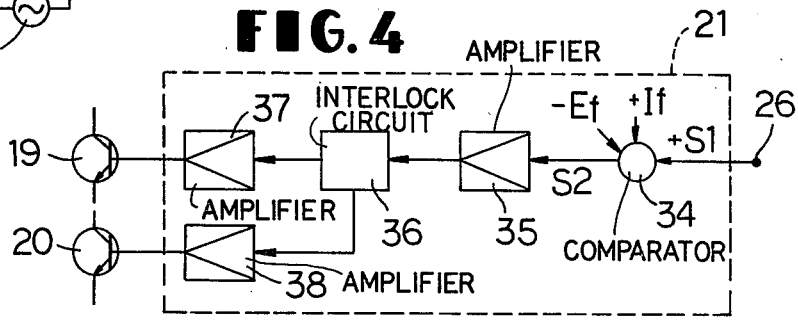
FIG. 4 is a detailed diagram of the speed controlling circuit.

Referring to FIGS. 3 and 4, the DC motor 5 is connected, via an full-wave rectifier 18, to an AC power source 17. A transistor 19 for driving power is connected in series to the DC motor 5; and a transistor 20 for dynamic braking power is connected across the terminals of the power source. The base of these transistors 19, 20 is respectively driven by a voltage from a speed controlling unit 21. Across a power supply lead 22 of 15 volts and lead 23 of 0 volt, which are connected to a speed controlling unit 21, are connected a variable resistor 24 (potentiometer) for low-speed-setting and a variable resistor 25 (potentiometer) for speed controlling with the object of varying the speed command for the DC motor 5. A tap 24*a* of the potentiometer 24 for low-speed-setting can be manually moved by an operator, and tap 25*a* of the potentiometer 25 for speed controlling is connected to the pedal 7 so it can be moved by a toe directional depressing.

Figure 5:
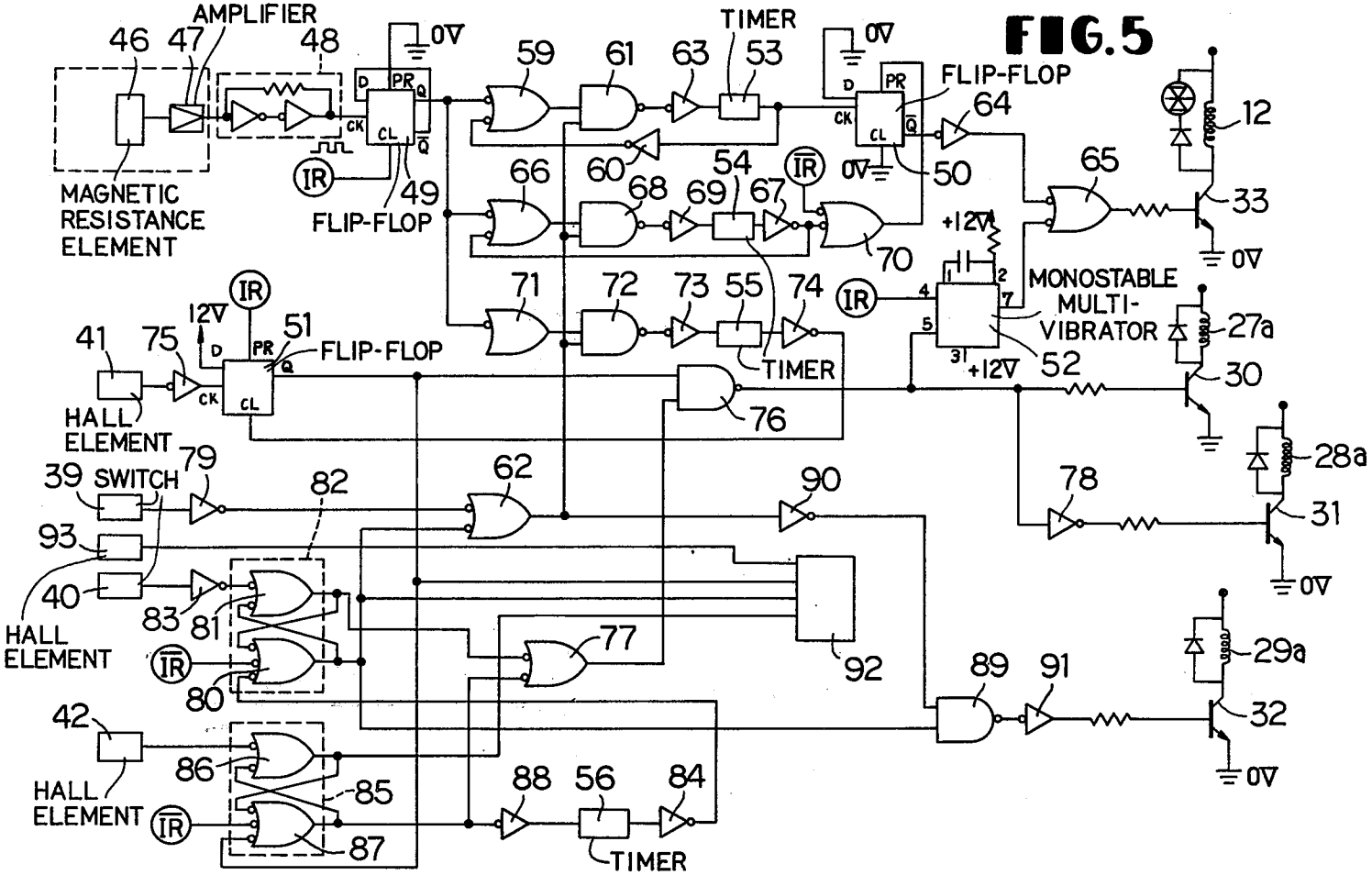
FIG. 5 is a diagram of the logic circuit.

An input terminal 26 of the speed controlling unit 21 receives a speed commanding voltage via three different routes, a first of which comes from the potentiometer 24 for low-speed-setting via normally open contact 27*b* of a first reed relay 27, a second of which comes from the power supply lead 23 via a normally open contact 28*b* of a second reed relay 28, and a third of which comes from the potentiometer 25 for speed controlling via a normally open contact 29*b* of a third reed relay 29. Numerals 93 and 94 respectively designate respective diodes. Coils, 27*a*, 28*a*, and 29*a* of respective reed relays 27, 28, and 29, are energized by transistors, 30, 31, and 32, which are respectively connected thereto, as shown in FIG. 5. The earlier mentioned coil 12 is energized by a transistor 33.

The speed controlling unit 21 will be explained referring to FIG. 4. An output signal S2 from a comparator 34 is produced as a result of comparison between the commanding input voltage S1 from the input terminal 26 and the value which renders a back E.M.F. voltage Ef of the DC motor 5 negatively fedback as well as a load current If positively fedback. This output signal S2 is to be amplified by an amplifier 35 for being supplied to an inter-lock circuit 36, which decides how to supply the driving pulses to, due to the output S2 from the comparator 34, the driving power transistor 19 and braking power transistor 20, respectively through amplifiers, 37 and 38. These two transistors 19 and 20 are basically supplied with continuous but mutually inversely phased pulses, i.e., when pulses to one side are larger in width those to the other side will be smaller, and when the speed commanding voltage is higher than that produced according to the actual rotation number, i.e., in the rising stage the driving power transistor 19 is conducted and the braking power transistor 20 is non-conducted, and on the contrary in the falling stage the braking power transistor 20 is conducted to interrupt the current to the driving power transistor 19. While the rotation speed is kept constant or unvaried the conduction takes place alternately to either of the two transistors 19 and 20 almost evenly. When the phase relation of the both pulses is in the medium condition between the abovementioned two cases, the time of the conduction is so controlled as to make either one of the two transistors 19 and 20 a little longer than the other.

A toe side depress switch 39, in FIG. 5, generates, when the pedal 7 is in the neutral position, a high level voltage signal (it is at 12 volts and hereinafter marked ONE for short), and when the pedal 7 is in the toe side depress it generates a low level voltage signal ZERO, and in the heel side depress a high level voltage signal ONE. A heel side depress switch 40 generates when the pedal 7 is in the neutral position or in the toe side depress, a low level voltage signal ZERO, and in case of heel side depress a high level voltage signal ONE.

Figure 6:
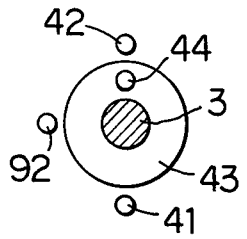
FIG. 6 is a diagrammatic view showing the position detecting means.

A needle lower position sensing Hall element 41 and a needle upper position sensing Hall element 42, with reference to FIGS. 5 and 6, are disposed over and below the machine drive shaft 3 taking a 180° phase difference to each other around the periphery of the drive shaft 3. On a rotary circular plate 43 secured to the drive shaft 3 is fixed a piece of permanent magnet 44. At every access to either of the Hall elements (41 or 42) the magnet 44 generates ZERO signal, and at the rest of the time generates ONE signal.

Figure 7:
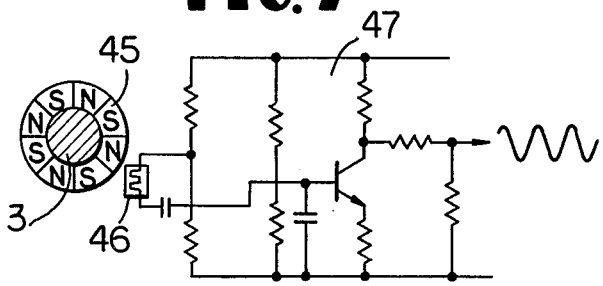
FIG. 7 is a diagram of the speed detecting circuit.
Figure 9:
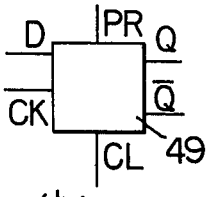
FIG. 9 contains explanatory diagrams and tables for the D type flip-flops.
Figure 9:
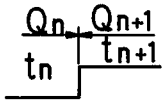

On the drive shaft 3 (FIG. 1) is disposed a magnetic pole wheel 45 (FIG. 1), which is composed of a plurality of permanent magnets, N and S of them being alternately placed so as to make a circular form as a whole, as shown in FIG. 7. At a confronting position thereto is disposed as magnetic resistance element 46, to which is connected an amplifier 47 for producing, with rotation of the magnetic pole wheel 45, an almost sine-wave-like output, the frequency of which is directly related to the angular velocity of the wheel 45. A Schmidt circuit 48 shapes the wave-form of the output from the amplifier 47, to the output stage of the Schmidt circuit 48 being connected a first D type flip-flop 49. The input and output terminals of the flip-flop 49 are shown in FIG. 9 (a) in an enlargement, wherein Q is an output terminal, $\overline{Q}$ an output terminal, CK a clock input terminal, CL a clear terminal, D a data input terminal, and PR a preset terminal. The truth table therefor is shown in FIG. 9 (*b*) and (*c*); FIG. 9 (*d*) is a table for reading the data of clock pulse in rising. Two other D type flip-flops, a second one being 50 and a third one 51, are of completely identical construction to the first D type flip-flop 49.

Figure 10:
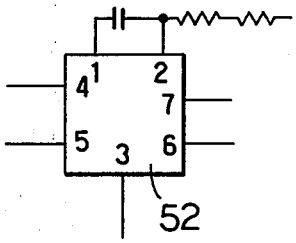
FIG. 10 is an explanatory diagram for the monostable multi-vibrator.

A monostable multi-vibrator 52 is for determining the energization time for the braking coil 12, the detail thereof being shown in FIG. 10, While "3" input terminal is kept at ONE, "4" input terminal being assumed at ZERO, an application of a trigger pulse to "5" input terminal will cause "7" output terminal to produce a monostable output. While "3" input terminal is kept at ONE, "4" input terminal is ZERO, and an application of a trigger pulse to "5" input terminal will, at a rising of "5" input trigger pulse, cause "7" output terminal to produce a monostable output. Applying ZERO on "3" input terminal will render "7" output ZERO, both "4" and "5" remaining unaffected.

A first variable timer 53 for speed detection determines the energization start timing for the braking coil 12, the timing being usually so set as to generate ONE signal after 2 to 3 mili-seconds of the impression of ONE on the same input terminal. A second variable timer 54 for speed detection is for determining the release timing of the energization of the braking coil 12, the timing thereof being usually so set as to generate ONE signal after 5 to 6 mili-seconds of the impression of ONE on the input terminal thereof. A third variable timer 55 for speed detection is for detecting the transference of the DC motor 5's running speed to a low speed condition, the timing thereof being usually so set as to generate ONE signal after 20 mili-seconds of the impression of ONE signal on the input terminal thereof. A fourth variable timer 56 is capable of detecting the needle upper position owing to the needle upper position detecting Hall element 42, generating ONE signal a short while after the impression of ONE on the input terminal thereof, and restricting the driving of the DC motor 5 in the meantime even if the pedal 7 should be depressed. In other words, it can function as a safety circuit for preventing the interference of the needle with the thread cutting device, because the driving of the DC motor 5 can be perfectly prevented, while the thread cutting is performed, from the detection of the needle upper position to the complete stopping of the machine at the needle upper position.

Figure 8:
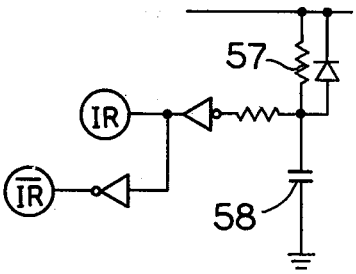
FIG. 8 is a diagram of the reset circuit.

FIG. 8 is a reset circuit at the time of power supplying. During the time (time constant), from the moment the power is supplied to the moment which is determined by the resistor 57 and the capacitor 58, the output IR is ONE and the one $\overline{IR}$ is ZERO. After elapse of the time constant, the output IR becomes ZERO and the one $\overline{IR}$ becomes ONE. The outputs IR and $\overline{IR}$ in FIG. 8 are to be applied respectively to all the identical designations shown in FIG. 5.

An OR circuit 59 having an input terminal takes, as its input, the Q output of the first D type flip-flop 49 and the output of an inverter 60 which takes, as its input, the output of the first variable timer 53. A NAND circuit 61 takes, as its input, the output of the OR circuit 59 and the output of an OR circuit 62 having an input terminal, the output thereof being to be impressed, via an inverter 63, on the first variable timer 53. The output of this timer 53 is impressed to the clock input terminal CK of the second D type flip-flop 50; and the output from the output terminal $\overline{Q}$ of the second D type flip-flop 50 is to be, via an inverter 64, impressed on an OR circuit 65 having an input terminal, whose output ONE will render the transistor 33 conductive.

An OR circuit 66 having an input terminal takes, as its input, the output Q of the first D type flip-flop 49 and the output of an inverter 67 which takes, as its input, the output of the second variable timer 54. A NAND circuit 68 takes, as its input, the output of the OR circuit 66 and the output of the OR circuit 62, the output thereof being to be, via an inverter 69, impressed on the second variable timer 54. An OR circuit 70 takes, as its input, the output from the aforementioned $\overline{IR}$ and the inverter 67, the output thereof being to be impressed to the preset input terminal PR of the second D type flip-flop 50. An OR circuit 71 takes, as its input, the output Q of the first D type flip-flop 49; and a NAND circuit 72 takes, as its input, the output of the OR circuit 71 and the output of the OR circuit 62, the output thereof being to be, via an inverter 73, impressed on the third variable timer 55. The output of the timer 55 is, via an inverter 74, impressed to the clear input terminal CL of the third D type flip-flop 51. To the clock input terminal CK of the third D type flip-flop 51 is impressed, via an inverter 75, the output from the needle lower position detecting Hall element 41.

A NAND circuit 76 takes, as its input, the output Q of the third D type flip-flop 51 and the output of an OR circuit 77 having an input terminal, the output thereof being to be impressed to the input terminal "5" of the monostable multi-vibrator 52, the base of the transistor 30, and the base of the transistor 31 via an inverter 78. An OR circuit 81 having an input terminal constitutes, together with another OR circuit 80, a flip-flop 82, wherein the former 81 takes, as its input, the output from the heel side depress switch 40, which has been reversed by an inverter 83, and the latter 80 takes as its input, the output of the $\overline{IR}$ and the output of an inverter 84 which takes the output of the fourth variable timer 56 as its input.

Another similar flip-flop 85 is composed of an OR circuit 86 having an input terminal and an OR circuit 87 having an input terminal, wherein the former 86 takes, as its input, the output of the needle upper position detecting Hall element 42, and the latter 87 takes, as its input, the output of the $\overline{IR}$ and the output Q of the third D type flip-flop 51. The output of the OR 87, one of the constituting members of the flip-flop 85, is impressed on the fourth variable timer 56, after having been reversed by an inverter 88, and also to one of the input terminals of the OR circuit 77, the other input terminal of which OR circuit 77 being connected to the output terminal of the OR circuit 81 in the flip-flop 82. A NAND circuit 89 takes, as its input, the output of the OR circuit 62, which has been reversed by an inverter 90, and the output of the OR circuit 80 in the flip-flop 82, the output thereof being to be impressed to the base of the transistor 32 after having been reversed by an inverter 91. A thread cut controlling circuit 92 takes, as its input, the output Q of the third D type flip-flop 51, the output of the OR circuit 80 in the flip-flop 82, the output of the OR circuit 86 in the flip-flop 85, and the output of the thread cut position detecting Hall element 93 which cooperates with the permanent magnet piece 44. The thread cut means (not shown) will be started to function, when the DC motor 5 is below the low speed and the pedal 7 is heel-depressed, by the low speed driving of the DC motor 5 and the rising of the needle from the lower position up as high as to actuate the thread cut position detecting Hall element 93 to operate; and the thread cut operation will be ceased as soon as the detecting of the thread position suited is made with the needle upper position detecting Hall element 42.

The operation and function of the exemplary embodiment will be described with reference to FIG. 5. At the time of power supply the input of the clear terminal CL of the first D type flip-flop 49 is ONE and the input of the preset terminal of the same PR is ZERO; so the output Q therefrom will be ZERO and the output of the OR circuit 71 will be ONE.

As the output of the toe side depress switch 39 at this time is ONE, one input of the OR circuit 62 will be ZERO and the output thereof will be therefore ONE, which renders all the inputs of the NAND circuit 72 ONE and the output thereof ZERO. The input of the third variable timer 55 is, in turn, impressed with a ONE, through the function of the inverter 73, which will lead to generating of the output ONE after a certain period of time. The clear terminal of the third D type flip-flop 51 will be consequently ZERO; the output Q thereof will be ONE, with the aid of the preset PR's being ONE.

On the other hand, the output of the OR circuit 81 in the flip-flop 82 is, due to the $\overline{IR}$, ZERO, which will be applied on one input of the OR circuit 77, with the result of rendering the output thereof ONE.

As the result, the NAND circuit 76 will be ONE at the both inputs thereof, and ZERO at the output thereof; from the "7" output terminal of the monostable multi-vibrator 52 will be generated a ZERO output with a desired width, which will be, in turn, impressed on the OR circuit 65. The output of the same 65 will be ONE, rendering the transistor 33 conducted, and the braking coil 12 will be thereby energized. As the substance-to-be-attracted is drawn to the supporting body 13 to stick thereto by the magnetism the machine 2 will not start working by the power supplying.

When the ZERO output at "7" of the monostable multivibrator 52 is changed to a ONE, either input of the OR circuit 65 will be ONE, which is caused by the impression of the output ONE from the first variable timer 53 on the clock input terminal CK of the second D type flip-flop 50, accompanied by the consequential impression of the ONE signal on the OR circuit 65 through the reversive function of the inverter 64 applied on the Q output, which has become ZERO, from the above flip-flop 50.

Then the output of the OR circuit 65 becomes ZERO for releasing the energization of the braking coil 12. The machine operator is allowed then to manually turn the pulley for adjusting the needle position.

The ZERO output from the NAND circuit 76 is to be impressed to the base of the transistor 30, which will therefore not be conducted and consequently a coil **27*a* of the first reed relay 27 is in a non-energization condition to keep the normally open contact 27*b* thereof open. On the other hand the transistor 31 is to be conducted, via an inverter 78, for energizing a coil 28*a* of the second reed relay 28** to close the normally open contact 28*b* thereof. The speed commanding voltage to the input terminal 26 will therefore be zero to hold down the DC motor 5 non-operating condition.

The ONE output of the OR circuit 62 is to be impressed on a NAND circuit 89, being reversed by an inverter 90, to render the output thereof a ONE, which will in turn be impressed to the base of the transistor 32, after having been reversed by an inverter 91. The third reed relay 29 is not energized at the coil 29*a* thereof to retain the normally open contact 29*b* open.

A slight depressing of the pedal 7 at this situation toward toe direction will render the output of the toe side depress switch 39 ZERO, which will be, after having been reversed to ONE by the inverter 79, impressed to one of the inputs of the OR circuit 62. Both inputs of the OR circuit 62 will therefore be ONE, and the output thereof becomes naturally ZERO. This ZERO output is impressed to all of the NAND circuits 61, 68, and 72, rendering the output thereof all ONE. The ONE is to be reversed to ZERO, respectively passing through the inverters 63, 69, and 73 and impressed to each timer 53, 54, and 55 for putting them in a reset condition. The output of the timer 55 is reversed by the inverter 74 to become ONE for being impressed to the clearence terminal CL of the third D type flip-flop 51, which makes the Q output thereof ZERO. It is delivered to the NAND circuit 76 for making the output thereof ONE.

The monostable multi-vibrator 52 will not generate a ZERO from the "7" output thereof for conducting the transistor 30 and nonconducting the transistor 31, which in turn energize the coil 27*a* of the first reed relay 27 to close the normally open contact 27*b*, and deenergize the coil 28*a* of the second reed relay 28 to open the normally open contact 28*b*. As the ZERO output of the OR circuit 62 is reversed by the inverter 90, both inputs to the NAND circuit 89 will all be ONE, the output thereof being naturally ZERO. It makes the output from the inverter 91 ONE, conducting the transistor 32 for consequently energizing the coil 29*a* of the third reed relay 29 with the result of closing the normally open contact 29*b*. At this time the tap 25*a* of the speed controlling potentiometer 25 is at the lowest position in FIG. 3, sending no speed commanding voltage.

The speed commanding voltage set at a value determined by that low speed setting potentiometer 24 (circa 215 r.p.m.) is imparted at this stage to the input terminal 26, and the power transistor for driving 19 energized by that speed commanding voltage will actuate the then stationary DC motor 5 to accelerate it up to 215 r.p.m.

Figure 11:
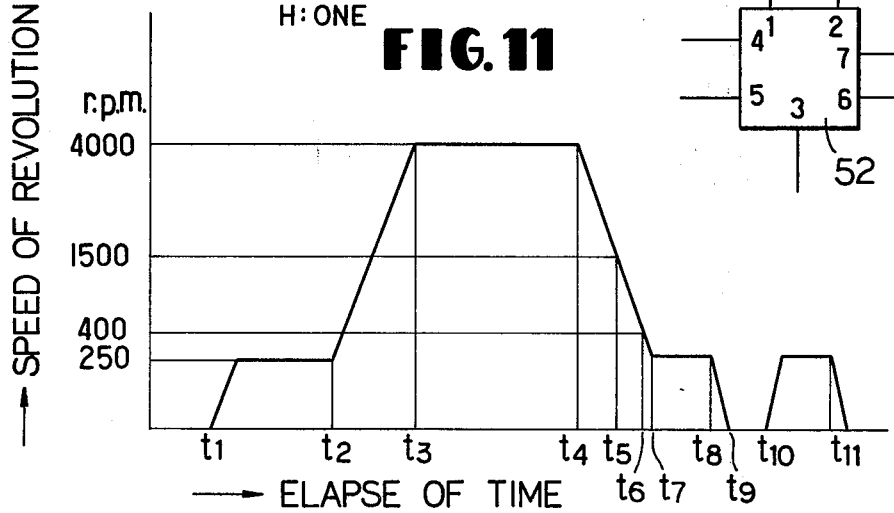
FIG. 11 is an explanatory graph useful in understanding the function of the present invention.

Under this low speed running the DC motor 5 is readily maintained at the low speed running according to the speed commanding, owing to the feedback of the back E.M.F. voltage Ef and the load current If. The power transistor 19 for driving and the power transistor 20 for braking are consecutively, but in alternation, conducted, as shown in FIG. 11 ranging from $t_1$ to $t_2$.

When the pedal 7 is afterwards depressed further toward the toe side, the tap 25*a* of the potentiometer 25 for speed controlling moves upwards (in FIG. 3) for raising the speed commanding voltage to the input terminal 26, which accelerates the DC motor 5 just like earlier mentioned. The line from $t_2$ to $t_3$ shall be referred to in FIG. 11 in this respect. When the pedal 7 is depressed to the deepest point, the DC motor 5 will be heightened its rotation approximately to 4,000 r.p.m., which high speed running can be maintained just as the low speed running, as shown in FIG. 11 as the line between $t_3$ and $t_4$.

When, after the desired sewing has been finished, the toe depressing of the pedal 7 is released (refer to FIG. 11 $t_4$), i.e., toe side depress switch 39 is released, the output becomes ONE, which will consequently be reversed by the inverter 79 to ZERO, and impressed on the OR circuit 62. It results in making the output of the OR circuit 62 ONE and impressing thereof on the OR circuits 61, 68, and 72 as well as on the inverter 90.

While the machine 2 is in rotation, the amplifier 47 generates, according to the rotation of the magnetic pole wheel 45, pulses close to sine-waves for being shaped by the Schmidt circuit 48. The pulses are at the rising thereof frequency-divided into one-half ($\frac{1}{2}$) by the first D type flip-flop 49 to be impressed on the OR circuits 59, 66, and 71, pulses of desired width, in inverse proportion to the r.p.m. of the machine 2, from these OR circuits being constantly impressed. As the output of the OR circuit 62 is at this time ZERO, the output from the NAND circuits 61, 68, and 72 are always ONE. As from the time, however, when the ONE output begins to be generated from the OR circuit 62 due to the release of the pedal 7, the ZERO output from the NAND circuits 61, 68, and 72 are to be respectively reversed to ONE by the inverters 63, 69, and 73 for being impressed on the timers 53, 54, and 55. During the decelerating period (from $t_4$ to $t_7$ in FIG. 11) up to the moment when the machine 2 reaches an r.p.m. in the neighborhood of 215, the third variable timer 55 is set to maintain its output in ZERO, not to generate ONE output. The output status of the third D type flip-flop 51 and the NAND circuit 76 is respectively maintained unchanged.

When the output of the OR circuit 62 is turned to ONE (when the pedal 7 is released), it will be reversed to ZERO by the inverter 90 for being impressed on the NAND circuit 89, rendering its output ONE, which is to be reversed again by the inverter 91, for being impressed on the transistor 32. The coil 29*a* of the third reed relay 29 is then released of its energization to open its normally open contact 29*b*.

From the above, the input terminal 26 will be impressed with a low speed commanding voltage which has been determined by the variable resistor for low speed setting 24, which conducts the braking power transistor 20 to rapidly decelerate the DC motor 5, by undergoing the dynamic braking, from the high speed running to the low speed running.

As soon as the machine's r.p.m. reaches about 1,500 ($t_5$ in FIG. 11) the first variable timer 53 begins to generate ONE output for being impressed to the clock input terminal CK of the second D type flip-flop 50, which results in, at the rising of those pulses, rendering the Q output ZERO and the $\overline{Q}$ output ONE because of the data input terminal D being ZERO. It is to be reversed by the inverter 64 for being impressed on the OR circuit 65, which makes the OR circuit 65 to generate a ONE output for conducting the transistor 33. The braking circuit 12 is energized by this; the substance-to-be attracted 16 will be drawn to stick to the supporting body 13 by the magnetism to mechanically brake the DC motor 5. And when the DC motor 5 comes down as low as an r.p.m. circa 400, $t_6$ in FIG. 11, the second variable timer 54 generates a ONE signal, which is to be reversed to ZERO by the inverter 67. The output of the OR circuit 70 will therefore be ONE, which is to be impressed to the preset terminal PR of the second D type flip-flop 50, for rendering the Q output thereof ONE and the $\overline{Q}$ output ZERO. It makes the output of the OR circuit 65 ONE. The output "7" of the monostable multi-vibrator 52 will be ONE and the output of the OR circuit 65 ZERO, for releasing the energization of the braking coil 12. When the machine's r.p.m. becomes low in this way, 215 or so, it is to be maintained as shown in $t_7$ to $t_8$ in FIG. 11 by the alternative energization of the driving power transistor 19 and the braking power transistor 20.

The output from the third variable timer 55 will then be ONE, which is to be ZERO reversed by the inverter 74 and impressed to the clear input terminal of the third D type flip-flop 51. When the needle lower position detecting Hall element 41, generates a ZERO output, by detecting the needle lower position, it will be impressed, having been reversed by the inverter 75, to the clock terminal CK of the third D type flip-flop 51 for rendering the Q output thereof ONE. Both inputs of the NAND circuit 76 become hence ONE and the output thereof naturally becomes ZERO. The transistor 30 will be hence nonconducted and the transistor 31 conducted; the coil 27*a* of the first reed relay 27 will be deenergized for opening the normally open contact 27*b*, and the coil 28*a* of the second reed relay 28 energized to close the normally open contact 28*b* thereof. The commanding voltage to the input terminal 26 will be zero (0) to conduct only the braking transistor 20 for dynamically braking the DC motor 5. From the "7" output of the monostable multi-vibrator 52 is generated a monostable output of ZERO; during this period an output of ONE is generated from the OR circuit 65 to conduct the transistor 33 and consequently the braking coil 12, causing the substance-to-be-attracted 16 to be drawn to stick by the magnetism to the supporting body 13. Then there occurs a dynamic braking to the machine 2 (refer to FIG. 11 from $t_8$ to $t_9$). The output width (ZERO level in this case) of the monostable multi-vibrator 52 is set before the machine is completely stopped working, in order to stop it at a needle lower position.

When the pedal 7 is depressed after that toward heel, the output of the heel side depress switch 40 becomes ONE, which will consequentially be reversed to ZERO by the inverter 83 to be impressed on the flip-flop 82, rendering the output of the OR circuit 82 ONE and that of the OR circuit 80 ZERO. Both inputs to the NAND circuit 89 will become ZERO, the output thereof becoming ONE and the output of the inverter 91 ONE, which makes the transistor 32 nonconducted and the coil 29*a* of the third reed relay 29 non-energized, either, with the result of opening the normally open contact thereof 29*b*.

As the output status of the flip-flop 85 is maintained unchanged, both inputs of the OR circuit 77 are ONE and the output thereof is of course ZERO, which ZERO is to be impressed on the NAND circuit 76 rendering its output ONE. It makes the transistor 30 conducted and the transistor 31 nonconducted. The coil 27*a* of the first reed relay 27 is consequently energized to close the normally open contact 27*b* thereof, and the coil 28*a* of the second reed relay 28 is energized to open the normally open contact 28*b* thereof, which makes the machine 2, in turn, to start in a low speed from the needle lower position upwards.

When an output is generated, in this condition, at the thread cut position detecting Hall element 92, the thread cut controlling circuit 91 is effectuated for actuating the thread cutting mechanism (not shown). As soon as the needle reaches the upper position ($t_{11}$ in FIG. 11) to make the needle upper position detecting Hall element 42 to produce an output ZERO, the output of the flip-flop 85 is reversed for rendering the output of the OR circuit ONE and that of the OR circuit 87 ZERO. It will cause one of the inputs of the OR circuit 77 to become ZERO, consequently the output ONE. Both inputs of the NAND circuit 76 become ONE to render the output thereof ZERO. The machine 2 will be in this way imparted a dynamic brake as well as a mechanical brake at the same time, just in a similar way to the needle lower stoppage, or being halted at a needle upper position. The energization of the thread cut controlling circuit 91 is released at the moment when the needle reaches the upper position, i.e., when the output of the OR circuit 86 of the flip-flop 85 becomes ONE. Completion of the thread cutting operation may sometimes be slightly later than this needle upper detecting moment according to the mechanism of the machine. The output of the OR circuit 87 of the flip-flop 85 is, due to the needle upper detection, reversed to ONE by the inverter 88, which ONE will be, after having been delayed a certain period of time by the fourth variable timer 56, conveyed to the inverter 84. This ONE will then be reversed to ZERO by the inverter 84 for being delivered to the OR circuit 80 of the flip-flop 82 as an input, whereby the output of the OR circuit 80 thereof becomes ONE and that of the OR circuit 81 ZERO. From this OR circuit 80 an output ONE is delivered to one input terminal of the OR circuit 62. A depress of the pedal 7, at this status, toward toe makes the both inputs of the OR circuit 62 ONE, causing the DC motor 5 to start just as earlier stated. Even when, by mistake, the pedal 7 is toe-depressed before the thread cutting mechanism has been effectuated by the heel-depress of the pedal 7 to carry out the needle upper position detection, the DC motor 5 cannot be started, because (1) due to the maintenance of the output ZERO of the OR circuit 86 of the flip-flop 85 and the output ONE of the OR circuit 87 unchanged; and (2) due to impression of no output ZERO on the OR circuit 80 of the flip-flop 82; in the flip-flop 82 the OR circuit 81 generates an ONE output and the OR circuit 80 generates an ONE output, consequently one of the inputs of the OR circuit 62 will be ZERO. This mechanism is a, so to speak, safety circuit for protecting the machine 2 from being damaged due to an interference between the thread cutting apparatus and the needle. The reason for inserting the fourth variable timer 56 resides in making a compensation by restraining the machine 2 from operation, during the time after the needle upper position has been detected until the various mechanisms (including the thread cut mechanism) are completely stopped (including inertia).

Reasons for, in the abovementioned embodiment, the mechanical brake being applied only during a deceleration process from a high speed running to a low speed running by means of a dynamic brake, especially between the range from 1,500 to 400 r.p.m., resides in that a simultaneous application of the mechanical brake, at the time of dynamic brake being in operation, is apt to increase the wear of the D.C. motor 5 and to deteriorate the braking effect. During the above range of the rotation speed the contacting portions are less worn and the braking effect is high. Various ways of imparting mechanical braking covering the entire range of the dynamic brake are also practicable in good efficiency. As for the electric braking, beside the dynamic braking, inverse voltage braking, regenerative braking, etc., are also practicable. This invention allows, not being limited to DC motors, to be applied to the induction motors or the like.

What is mentioned above in greater detail about this invention can be summarized in other words as follows:

(1) while letting a motor to slow down by a deceleration command from a high speed running to a low speed running by means of an electric braking circuit;

(2) actuating a mechanical braking means to act on the motor, during at least a part of the electric braking application period; and (3) actuating, by means of a stopping command, the electric braking circuit and/or the mechanical braking means to stop the motor.

What is claimed is:

1. An electrical drive system for a sewing machine having a drive shaft, the system comprising:

a motor drivingly connected with said drive shaft, a speed control circuit connected with said motor for controlling the speed of the same and including a low speed setting circuit;

an electrical braking circuit provided within said speed control circuit for electrically braking said motor upon a deceleration command coming thereoutside;

electromechanical braking means for frictionally braking a rotating member driven by said motor;

first control means for effecting said electromechanical braking means for a predetermined period during a deceleration period from the normal running speed to said low speed controlled by said low speed setting circuit; and second control means for effecting both or either of said electrical braking circuit and said electromechanical braking means upon a stopping command generated in the low speed condition of said motor.

2. An electrical drive system according to claim 1, in which said motor is a DC motor.

3. An electrical drive system according to claim 1, in which said electric braking circuit is a dynamic braking circuit.

4. An electrical drive system according to claim 1, in which said first control means comprises:

detecting means responsive to said motor having reached a predetermined speed which is a predetermined amount higher than said low speed for generating a detection signal; and means coupled to said detecting means and responsive to said detection signal for effecting said electromechanical braking means in response to the detection signal.

5. An electrical drive system according to claim 1, in which said first control means comprises:

a first means for detecting said motor having reached a predetermined speed which is a little higher than said low speed and for generating a first detection signal;

a second means for detecting said motor having reached a predetermined speed which is lower than said predetermined speed detected by said first detecting means and for generating a second detection signal; and means for energizing said electromechanical braking means in response to the first detection signal and deenergizing the same in response to the second detection signal.

6. An electrical drive system according to claim 1, wherein said motor has a bracket and in which said electromechanical braking means is attached to said bracket of said motor.

7. An electrical drive system for a sewing machine having a drive shaft, the system comprising:

a DC motor drivingly connected with said drive shaft;

a speed control circuit connected with said DC motor for controlling the speed of the same and including a low speed setting circuit;

a dynamic braking circuit provided within said speed control circuit for dynamically braking said DC motor upon receipt of an external deceleration command signal;

electromechanical braking means for frictionally braking said DC motor;

a first control means for effecting said electromechanical braking means when the speed of said DC motor has arrived at a predetermined speed which is a little higher than said low speed during a deceleration period from the normal running speed to a low speed controlled by said low speed circuit; and a second control means for effecting both of said electrical braking circuit and said electromechanical braking means upon receipt of a stopping command generated in the low speed condition of said DC motor.

8. An electrical drive system according to claim 7, in which said speed control circuit comprises:

a drive power transistor connected in series with said DC motor; and a dynamically braking power-transistor resistively connected in parallel with said DC motor.

9. An electrical drive system according to claim 7, in which said speed control circuit comprises:

speed control means operated by a foot treadle for controlling the acceleration and the deceleration of said DC motor.

10. An electrical drive system according to claim 7, including means for producing said deceleration command signal upon release of a foot treadle.

11. An electrical drive system according to claim 7, in which said first control means comprises:

means for generating a speed representative signal, first means for detecting the arrival of said DC motor to a predetermined speed a little higher than said low speed in response to the speed representative signal and generating a first detecting signal;

second means for detecting the arrival of said DC motor to a predetermined speed lower than said predetermined speed detected by said first detecting means in response to the speed representative signal and generating a second detecting signal; and means for energizing the electromechanical braking means in response the first detecting signal and deenergizing the same in response to the second detecting signal.

12. An electrical drive system according to claim 11, in which said speed representative signal generating means comprises:

a magnetic pole wheel drivingly connected with said drive shaft to generate a variable frequency signal directly related to shaft speed; and sensing element cooperating with said magnetic pole wheel for generating a speed representative signal.

13. An electrical drive system according to claim 11, in which each of said first and second detecting means includes:

means for detecting the width of the speed representative pulse signal.

14. An electrical drive system according to claim 11, which further comprises:

third means for detecting the arrival of said DC motor at the low speed;

whereby said dynamic braking circuit and said electromechanical braking means are effected upon detection of said low speed by said third detecting means.

15. An electrical drive system according to claim 7, a needle position detecting means attached to said drive shaft for developing a stopping command signal.

* * * * *